United States Patent [19]

Vezirian

[11] Patent Number: 4,623,027

[45] Date of Patent: Nov. 18, 1986

[54] UNSEGMENTED ROTARY ROCK BIT STRUCTURE AND HYDRAULIC FITTING

[76] Inventor: Edward Vezirian, 110 Firwood, Irvine, Calif. 92714

[21] Appl. No.: 745,081

[22] Filed: Jun. 17, 1985

[51] Int. Cl.[4] ..... E21B 10/18

[52] U.S. Cl. ..... 175/340; 175/356; 175/358; 175/374; 76/108 A

[58] Field of Search ..... 175/339, 340, 342, 356, 175/358, 374, 393, 409, 422 R; 76/108 A

[56] References Cited

U.S. PATENT DOCUMENTS

| | | | |
|---|---|---|---|
| 2,719,027 | 9/1955 | Boice et al. | 175/340 |
| 2,782,005 | 2/1957 | Appleton | 175/339 |
| 3,195,660 | 7/1965 | McKown | 175/339 X |
| 3,363,706 | 1/1968 | Feenstra | 175/340 |
| 3,509,952 | 5/1970 | Galle | 175/339 |
| 3,850,256 | 11/1974 | McQueen | 175/339 X |
| 4,068,731 | 1/1978 | Garner et al. | 175/339 |
| 4,126,194 | 11/1978 | Evans | 175/340 |
| 4,158,973 | 6/1979 | Schumacher, Jr. et al. | 175/342 X |
| 4,185,706 | 1/1980 | Baker et al. | 175/340 |
| 4,239,087 | 12/1980 | Castel et al. | 175/340 |
| 4,240,513 | 12/1980 | Castel et al. | 175/340 |
| 4,266,622 | 5/1981 | Vezirian | 76/108 A X |

FOREIGN PATENT DOCUMENTS

| | | | |
|---|---|---|---|
| 2540097 | 3/1977 | Fed. Rep. of Germany | 175/422 R |
| 1023419 | 3/1966 | United Kingdom | 175/339 |
| 344099 | 8/1972 | U.S.S.R. | 175/339 |

*Primary Examiner*—James A. Leppink
*Assistant Examiner*—John F. Letchford

[57] ABSTRACT

An unsegmented structure for a rotary rock bit is disclosed comprising a one piece body of spring steel wherein individual journal members after being assembled with associated rotary rock cutters are interference fit to the free ends of downwardly directed leaf spring draw bars depending from the lower periphery of the pin end flange, to provide resistance to damage from transcient forces.

A high capacity laminar flow hydraulic system which uses no nozzles delivers drilling fluid to the bore hole bottom and produces a low pressure region at that location via the Bernoulli effect to provide positive chip cleaning and flushing.

9 Claims, 4 Drawing Figures

UNSEGMENTED ROTARY ROCK BIT STRUCTURE AND HYDRAULIC FITTING

BACKGROUND OF THE INVENTION

1. Field of the Invention

This invention pertains to improvements in the structural body of a rotary rock bit. More specifically, this invention relates to the hydraulic function, metallurgical treatment manufacturing method, and assembly of the structural body of a rotary rock bit.

2. Description of the Prior Art

This discussion is limited to rock bits having a plurality of rotating toothed cutters which are generally somewhat conical in form. This common type of rock drill bit has not changed substantially in bodily structure in over half a century. The conical rock cutters are rotatively borne upon cantilevered journal shafts which enter the cutter bearings normal to, and central to the base of the cones. The journal shafts are directed angularly downward and radially inward relative to the centerline of the vertically cylindrical bit body. The bit body supports the journal shafts from its lower periphery, having an upper end, called the "Pin End", which is threaded for attachment to the lower end of a drill line made of pipe. The bit body also serves the function of a terminal pipe fitting to control and route a fluid flow from the drill line pipe to exit through the plurality of mud nozzles housed therein.

In use, the drill line pipe is rotated while forcing the rock bit into the earth. The rock cutter cones, with their vertices directed toward the centerline of the drill bit, roll about the centerline of the drill bit as the rock cutting teeth are forced into the geologic formation to crush and fracture it. Fluid pumped down the drill line and through the nozzles serves both to dissipate the heat of drilling, and to flush cuttings from the drilling zone and buoy them upward to the surface through the annular space between the bore hole wall and the drill line pipe.

To permit assembly of the rock cutter cones upon their respective journal shafts, the structural body of the rock bit is made in separate longitudinal segments, called "Legs", each leg incorporating one journal shaft. The segments are welded into an integral unit after being assembled with the cutters. After welding, the pin end is threaded for attachment to the lower end of the drill line.

Inventors in the art have long recognized the advantages to be realized in production of a rotary rock bit with an unsegmented body structure, yet the segmented form has remained the standard of the industry.

U.S. Pat. No. 1,388,424 issued to George in 1921 teaches the use of a unitary bit body having four conical cutters with axes nearly vertical, two being convergent and two being divergent. The cones and journals are shown integral, rotatively supported in bushings housed within the bit body. Unfortunately the cutting geometry of this design appears to be non-aggressive.

Clarence Reed, a prolific inventor in the art, describes in U.S. Pat. No. 1,636,666 and more particularly in U.S. Pat. No. 1,692,793 a two cone rock bit of conventional cutting geometry featuring a one piece rock bit body. Individual journal shafts depend from vertical posts which are mechanically drawn into bores within the bit body after assembly of the rotary cutters.

Swift and Dalldorf were granted U.S. Pat. No. 1,726,049 on a unique rock bit having three cutters with vertical axes mounted in a straight line. The cylindrical cutters carried helical teeth which intermeshed to provide mutual cleaning and synchronous rotation. The cutters depend from a one piece bit body, however, the design is both non-aggressive in cutting action and structurally weak for use in even very soft geologic formations.

U.S. Pat. No. 2,061,657 by Howard, assigned to Globe Oil Tools Company represents a notable design advance which suffered commercially from bad market timing. Two cutters depend from a one piece bit body. Near vertical journal shafts are used with strong negative camber. The upper stator end of each journal shaft is drawn into a matching locking taper within the body and secured, in the production model, by a nut on the threaded extension of the journal shaft. The patent drawing, however, depicts use of a flat drive key with a locking taper. The cutting geometry was made effective by the use of the negative camber. The Howard patent was applied for in May of 1933, but before it came to issue in November of 1936, the well known three cone bit of current commerce, U.S. Pat. No. 1,983,316 by Scott et al, assigned to Hughes Tool Company was issued, and has since preempted the marketplace.

An English inventor, Lanchester, in U.S. Pat. No. 2,648,526 teaches the use of a one piece bit body in a three cone rock bit. The independent journal shafts depend from cylindrical posts which are threadingly drawn and secured into vertically converging bores within the bit body.

A novel cutting structure using three interleaving cutters with integral journal shafts having vertically converging axes are rotatively supported by roller bearings within the one piece bit body, is described in U.S. Pat. No. 2,915,291 by Gulfelt.

The two latter designs seem never to have been commercialized.

With the advent of Electron Beam Welding, a number of patents have been issued directed to the use of this process in the production of rock bit designs having unsegmented bit bodies. U.S. Pat. Nos. 3,850,256 McQueen, 4,145,094 Vezirian, 4,158,973 Schumacher, 4,187,743 Thomas, and 4,256,194 Varel, are all illustrative of this trend. Although all of these efforts relied upon conventional prior art rotary cone cutting geometries, commercial use has not been seen. U.S. Pat. No. 4,209,124 by Baur, however, is directed to a fixture for electron beam welding a conventional segmented bit body together and is widely practiced.

U.S. Pat. No. 4,335,794 by Goodfellow shows an unsegmented bit body with an open cylindrical "Pot" formed within the lower end. Cones are mounted on journals which depend from short "Legs" which are configured to fill the pot annularly, leaving a tapered bore at the center which is then filled with a tapered plug, in turn secured by a central bolt.

Drilling hydraulics has long been a subject of general interest and study, although one with only marginal gains in practice. When drilling commences, water is pumped down the drill line and through the nozzles provided within the bit body to direct accelerated fluid streams toward the drilling zone. This fluid flow is provided for two purposes; to flush cuttings from the drilling zone and up the annular space between the drill line and the bore hole wall to the surface, and to dissipate the heat of drilling. As drilling progresses and the well bore becomes deeper, the viscosity and specific gravity of the drilling fluid must be increased in order to buoy the cuttings to the surface. Such altered fluids are known generically as "Mud". Additionally, fiberous or pulpy ingredients are added as needed to stem the loss of fluid into porous or fractured geologic formations. Such ingredients are commonly called "Lost circulation materials".

Upon returning to the surface, the mud is screened of coarse debris and then routed to a settling pond where finer debris is shed by gravity. Fluid drawn from near the surface of the pond is then used in the production of "Fresh" mud for use in continued drilling. The fresh mud contains retained fines, and when pumped down the drill line at a typical three thousand pounds per square inch pressure, will find a toehold for rapid destructive abrasive erosion in any pin-hole or crack in the drill line or rock bit body.

The conventional mud nozzle is a sharp edged orifice made of Tungsten Carbide. One such nozzle is usually provided for each rotary rock cutter and is positioned fully above the cutters relatively close to the bore hole wall, directing a high velocity fluid stream downward between cutters and radially outward against the bore hole wall. It should be noted that the stream fans out conically at a substantially high rate after leaving the nozzle.

The fluid path from the pump down the drill line is relatively free flowing until suddenly impacting the inside floor of the rock bit body. From that point the flow is very turbulent as it "cloverleafs" into coriolis circulations above each of the ports leading to the exit nozzles. In the turbulence within the bit body and in the throttling action of the mud nozzles, a drop in hydraulic pressure occurs which accounts for from fifty percent to about sixty five percent of the energy delivered by the mud pump, under favorable drilling conditions. The pressure dropped across the nozzles is sought in practice, in an attempt to reach hole bottom with the projected fluid streams.

Generous vertical channels are formed between the exterior wall of the rock bit body adjacent the nozzle locations and the bore hole wall, being provided by design to permit the free flow of fluid and entrained cuttings from the drilling zone.

Actually, the high velocity fluid cone directed across the entrance to each channel is particularly effective in blocking any fluid flow up the channel. A "hold down effect" is therefore generated which serves to keep the more substantial rock chips on the hole bottom to be ground to dust size by the rolling cutters. Ultimately, large volumes of very fine debris are forced to exit the cutting zone by passing through the wedge shaped clearance between the large end of the cutter and the bore hole wall. This action is directly accountable for the condition known as "Shale Packing", which causes the early destruction of the elastomeric seal protecting the journal bearing. Additionally, this process serves to load up the settling pond with large amounts of abrasive fines in an escalating destructive cycle. The initial step in this process, the crushing to dust of cuttings by the cutters, both impedes the penetration of the rock bit into the geological formation and abrasively wears the teeth of the rock cutters.

U.S. Pat. No. 2,901,223 by Scott, proposes a centrally located cluster of three nozzles to discharge radially outward and downward between cutters which are relatively smaller than commonly used to that they can be mutually spaced apart to avoid excessive abrasion from the nozzle discharge. Obviously this design still serves to block the entrances to the vertical chip clearance channels. This invention was intended for use in soft gummy formations.

Johnson, in U.S. Pat. No. 3,528,704 and again in U.S. Pat. No. 3,713,699 teaches the use of cavitating nozzles directly as cutting tools against the rock. A fluid stream is pulsated at high frequency and enough energy to physically vaporize the fluid in the low pressure phases of the vibratory wave. The vapor bubbles thus produced implode in the high pressure phases of the same waves, and, if very close to the rock surface, cause particles of the rock to erode away in tension. Unfortunately, cavitation is a low pressure phenomenon, and cannot be practiced in any but shallow wells.

U.S. Pat. No. 4,126,194 by Evans, is directed to the use of a tube, used in place of one nozzle, having an inlet end located on hole bottom between cutters, and having a discharge end open as a point above the discharge points of the retained nozzles. A naturally occurring differential pressure is relied upon to route cuttings from the hole bottom up the channel.

Another patent directed at drilling problems encountered in soft gummy formations, U.S. Pat. No. 3,823,789 by Garner, uses an additional nozzle located on the bit centerline, directed downward, to break up the ball that persists in forming at that location. This nozzle emits a diffused stream to avoid excessive abrasive action against the cutters. A center nozzle is current accepted practice used in conjunction with "Extended Nozzles". The extended nozzle is a short cast tubular extension which is welded into the existing nozzle port, holding in turn a very small carbide nozzle which discharges downward between cutters from about the level of the centroid of the rotary cutters. Dramatic rates of penetration are gained with this nozzle combination in certain very soft formations, however the extensions have proven to be very fragile, tending to snap off during drilling thus threatening well completion.

A very strong extended nozzle is disclosed in U.S. Pat. No. 4,077,482 issued to Ioannesian et al of Moscow U.S.S.R.. Only one nozzle is used by Ioannesian, requiring a separate special body segment to support it. Being a Russian production however, we know nothing about its field history.

Conventionally, rock bit bodies are forged, in segments, of steels such as 8610 or 4815 which are case hardening grades. After selectively case hardening, and some localized hard facing, and after the conical rock cutters are assembled to their journal shafts, the segments are welded together into an integral body. The pin end is annealed after welding to permit threading, which is the final machining operation. The massive core sections are left relatively soft intentionally because the soft steel is tough and resists fracturing. A fracture generally means that part of the bit is lost in the well bore jeopardizing well completion.

During drilling operations forces are sometimes encountered which tend to pinch the rotary rock cutters into impingement, rendering the rock bit useless because the soft metal of the body yields maintaining the pinched condition and preventing rotation of the rock cutters. The very unfortunate truth is that the forces are transient, and that most frequently they come to bear upon a new bit during its introduction to the well bore.

SUMMARY OF THE INVENTION

This invention is directed to the use of an unsegmented one piece rock bit body supporting individual journal shaft members in interference fit thereto. Each individual journal shaft member is finish machined, heat treated, and assembled to its associated rotary rock cutter prior to being assembled to the finish machined and heat treated unsegmented bit body. Several aspects of this rock bit structure, although inseparably interrelated, must be individually addressed: form, hydraulic function, metallurgy and heat treatment, and the methods of production and assembly.

FORM

The central driving flange and the abutting male threaded tapered "pin end" or nipple are specified and controlled in form and dimension by "American Petroleum Institute" (A.P.I.) standards, which are included by reference in this specification. These features are fully machined prior to heat treat hardening, this being a departure from prior art practice wherein the bit body segments are heat treat hardened first, and the pin end then locally annealed and finally threaded and sold in the softened conditioned.

Extending downward from the machined flange, one bar member is provided for each rotary cutter to be supported by this bit body. This bar member, generically called a "draw bar", is a stout cantilevered flat tapered leaf spring used to support the associated journal member and rotary rock cutter assembly. The draw bar is designed as a spring in order that transient drilling forces tending to pinch the rotary cutters together will produce only momentary deflections within the draw bar instead of fractures or permanent distortions of the supporting structure. The draw bar is preferably tapered in thickness, being thickest at the supporting flange, in order to distribute working stresses along the working length of the bar thus avoiding the otherwise normal concentration of those forces at the line of attachment to the supporting flange.

At final assembly, the individual journal member, having been previously assembled with its rotary rock cutter cone, receives the free end of the draw bar into a deep socket, formed within the journal member, with a substantial interference fit. Primary retention is by virtue of this interference fit, however, a secondary retaining device is also preferred, being, for example, a cross pin or key engaging both the journal member and the draw bar.

A plurality of stout tubular extensions, called "mud snouts", which are sector-shaped in cross section, extend from the central area of the flange of the bit body to discharge at points very near the lower extremity and outer periphery of the finished bit. The design of the snouts is addressed in the section on hydraulic function. The mud snouts gain strength from their sector-shaped cross section which is tapered, being largest at the flange supported end, and from a pattern of radial external structural webs which also reenforce and ridgidize them.

The location, orientation, and geometry of features occurring repetitively on a single bit structure are more controllable and are more reliably reproduced from bit to bit in the instance of this unsegmented design than in the prior art design; a goal long sought in the industry and referred to as "true geometry".

The elimination of welding, as between the body segments, also eliminates the production thereby of interfacial separations, voids, cracks, pin holes, or pits which may permit erosion by abrasive fluid intrusion, and the ultimate early failure of structure by that process.

HYDRAULIC FUNCTION

The hydraulic design is a major departure from the prior art in form, function, and in the way it is used in the field. A major purpose behind this design is the conservation of hydraulic energy for use after exiting the bit structure, in the primary usages of the hydraulic circuit; flushing cuttings from the drilling zone, cooling the rock bit, and buoying the debris up the bore hole annulus to the surface. Ideally then, a relatively smooth laminar flow must be maintained within the bit body, without abrupt changes in direction or cross sectional area. The hard throttling nozzle of the prior art, which accounted for the majority of the hydraulic energy dissipation, is not used in the practice of this invention.

The cylindrical coolant column entering through the extended end of the nipple of the bit is smoothly divided into "pie slices", initially having the same composite cross sectional area as did the original column. These pie slices then diverge radially outward from the bit longitudinal centerline to define the bores of the radially diverging mud snouts. From the point of separation from the cylindrical column to a point near the bore hole periphery these sector shaped bores taper downward in cross section, serving to slightly accelerate the fluid flow within, and permitting the downward curving mud snout to pass vertically between the rotary rock cutters with a constant cross section. The internally formed hydraulic conduit is adapted to convey drilling fluid through the bit structure in a smooth laminar flow, relatively free of turbulence and with a minimum or throttling. The mud snouts terminate in a sharp edged open end spaced a very short uniform distance off the plane against which the journal shafts will support rotating rock cutters. The teeth of the rotary rock cutter are normally forced into the geological formation, therefore the functional rock drilling plane is defined by the rolling path of the solid shell of the rock cutter cones and not by any portion of the teeth.

Maintaining the sector shaped cross section of the fluid flow from the point of separation to the point of discharge is of particular importance because abrupt changes in the shape and turbulence associated with such changes are avoided, and more importantly, turbulence arising from skin friction within the conduit naturally migrates to the inside corners of the sector, thereby aiding the free laminar flow through the central portion of the conduit and minimizing energy losses in the course of passage.

Five hydraulic effects not achieved in the prior art now accrue:

First; full abrasive cutting capacity of the high velocity and high pressure fluid stream comes to bear against the rock surface of the drilling face directly beneath the mud snout exit. The destructive force of the mud column is directed at the formation rather than at a tungsten carbide nozzle.

Secondly; cracks or fissures in the rock surface in the area blasted by the direct fluid stream, including such as may be caused by the preceding cutter teeth, can be entered by the high pressure mud to fail the rock from within by tension.

Thirdly; as the high pressure fluid stream escapes through the narrow aperture between the mud snout exit and the rock surface, a very high velocity fluid sheet is formed spreading across the hole bottom surface. The "Bernoulli Effect" of hydrodynamics (the same effect that produces lift on an airplane wing) produces a low pressure region immediately above the rock surface sufficient to lift rock chips and send them off up the annulus toward the surface. The annular band of rock beneath the path of the mud snouts is now exposed to substantial abrupt changes in hydraulic pressure to physically aid in the disintegration of rock and the rapid removal of rock cuttings.

Fourthly; the entire mud column is released at hole bottom with a substantially greater percentage of remaining hydraulic pressure than was possible in the prior art. The only possible flow patterns must move upward, and operate to entrain and transport cuttings upward and away from further mutually damaging contact with the rotary rock cutters. The pressure drop across the mud snout discharge apertures is relatively low compared to that produced by most mud nozzles, and no energy is spent in the generation of high energy fluid streams counter-productively directed downward. No "Hold Down" forces exist.

Fifthly and finally; the large channels provided for the free exit of cuttings are wide open to pass copious flows of fluid carrying both heat and large entrained cuttings up the bore hole as desired. No high energy fluid streams are produced to block the entrance of the channels and to erosively impinge the bore hole wall as in the prior art.

One of the greatest problems encountered in deep well drilling is that of cleaning the drill face and flushing the cuttings to the surface. Over the last sixty years a pseudo-science has developed surrounding the publication of the results of studies into the influence a driller might exercise toward favorably unbalancing the counter productive hydraulic forces at work in the drilling zone. Actually, only two variables are provided; mud pump output pressure, and the orifice size of the nozzles used. Results at best are only marginal, but have been consequently of urgent importance to the livelihood of the driller.

Nozzles are selected and installed before the bit enters the bore hole, based largely on conjecture of what conditions the bit will encounter in the near future, down hole. Therefore, particularly in light of the present disclosure, the entire publishing industry surrounding this subject matter stands in much the same light as that surrounding the subject of stock market investing.

From "Drilling Engineering Handbook" by Ellis H. Austin, published by "International Human Resources Development Corporation" of Boston, 1983, page 138 in part . . . "ideally the pressure drop across the nozzles should be from about fifty percent to about sixty five percent of the total supplied by the mud pump" . . . . Note that "pressure drop" is synonymous to "energy dissipation".

The rock bit body structure of the instant invention produces an inconsequential internal pressure drop, the triangular fluid passages being extremely efficient, and the pressure drop generated across the narrow aperture between the mud snouts and the rock face is used productively to produce a dynamic lift on the hole bottom by the aforementioned Bernoulli Effect. In the process of generating this seemingly incongruous low pressure layer at the point normally exposed to the maximum system pressure, only upward directed fluid flow is possible, eliminating the unbalancing problem so freely addressed in the literature. The nozzles of the prior art were used to produce a large pressure drop in order to gain a very high velocity fluid stream in the hope that such a jet might reach hole bottom. It should be obvious that the higher the velocity, the "stiffer" the stream and the more effective a block to the entrance of the chip clearance channels. Mud nozzles are conventionally made of expensive Tungsten Carbide to resist the heavy abrasive cutting action encountered by the member. In the instant invention, this abrasive action is borne by the rock formation over the comparatively large area of the mud nozzle exit and by the long periphery of the mud snout end.

A previously unaddressable problem encountered by drillers exists in easily erodible formations where the streams from the nozzles cause the bore hole to run excessively oversize. The action of the bit structure herein described, is to apply high forces toward eroding the hole bottom, thus aiding the rate of penetration, and directing the destructive portion of the flow radially inward instead of at the hole wall itself.

Under most drilling conditions, a reduced pressure will be required of the mud pump at the surface, thus adding materially to the useful life expectancy of that expensive utility, as well as of the engine used to operate the mud pump. No nozzles are used in the rock bit structure herein described, leaving the control of the mud pump as the only controllable variable in the fluid circuit, except for the mud composition which is controlled in response to other parameters, and consequently the savings available via mud pump management should generally receive the attention required to realize those savings.

METALLURGICAL TREATMENT

Prior art rock bit bodies are formed of alloys having a high response to case hardening treatments. Thick heavy cross sections typical of the prior art were relatively soft beneath the hard case which provided a structure which was tough and resistant to fracture even when radically deformed, endowed with a wear resistant surface. While the case does lend some strength, that strength is lost when deformations cause it to craze, or even to spall away. This practice has been justified because fracture is considered a catastrophic failure, usually meaning that parts of the bit are lost in the bottom of the hole, entailing an expensive fishing operation at best, or loss of the hole at worst. The practice is undesirable from the standpoint that steels of this character tend to yield when they deform, rendering such deformation permanent, thus generally ruining the bit.

An entirely different tack is used in the design of the instant bit body structure, an approach not possible with a welded segment structure.

The alloy selected is compounded for the production of springs and, within limited thickness of cross section, is through hardening. Although sections used are lighter, this bit body structure is potentially substantially stronger than prior art body structures of more massive section. After all machining, the steel is heat treated to spring hardness and carefully Martempered to provide satisfactory impact resistance.

Transitory forces encountered in drilling or in introducing a new bit to an undersize bore hole, sometimes serve to cripple prior art rock bits by pinching the rotary cutters together into permanent mutual interference so that they can no longer rotate. Such forces are not such a threat to the instant bit body structure. The cutters may be pinched toward one another, up to a point where hard stops protect the cutters integrity, but when those forces subside then the spring action provided by the draw bars will return the cutters to their original positions for continued drilling. It should be noted that this feature is provided as an improvement in the prior art and is not to be thought of as making this structure "indestructible".

Hardened steels are known generally to fail in brittle fracture at substantially lower stress levels when suddenly loaded, as in impact, than when more slowly or statically loaded. In order that this bit body structure be able to withstand the severe shock loading encountered in drilling, it should be carefully Martempered to eliminate as much retained austenite as is practically possible. Precautions to prevent surface decarbonization during heat treatment is also desirable in the interest of maintaining abrasion resistance, and long service life expectancy.

Because of the critical nature of the metallurgical treatment given this ultra high strength spring steel bit body structure, thermal welding of any sort should not be permitted, even in small spots, since these processes upset the micro-structure, create stress concentrations, and serve to defeat the conditions generated by the heat treat processes.

Clearly the shape of the instant bit body structure does not lend itself to formation by forging. Fortunately, high quality parts are consistently produced by casting, and casting provides a more uniform dimensional reproduction in the long run than the dies of forging can provide.

One object of this invention is to provide a substantially more durable and longer lasting bit body structure.

Another object of this invention is to provide a rock bit body structure incorporating an integral hydraulic system more efficiently utilizing surface supplied hydraulic power to positively sweep and flush cuttings from the drilling zone and up the bore hole annulus, being controllable from the surface.

Yet another object of this invention is to provide a rock bit body structure with a defined and consistently reproducible geometry, as can now be identified as "True Geometry".

The above noted objects and advantages of the present invention will be more fully understood upon a study of the following description in conjunction with the detailed drawings.

DESCRIPTION OF THE PREFERRED EMBODIMENT AND BEST MODE FOR CARRYING OUT THE INVENTION

Figure 1:
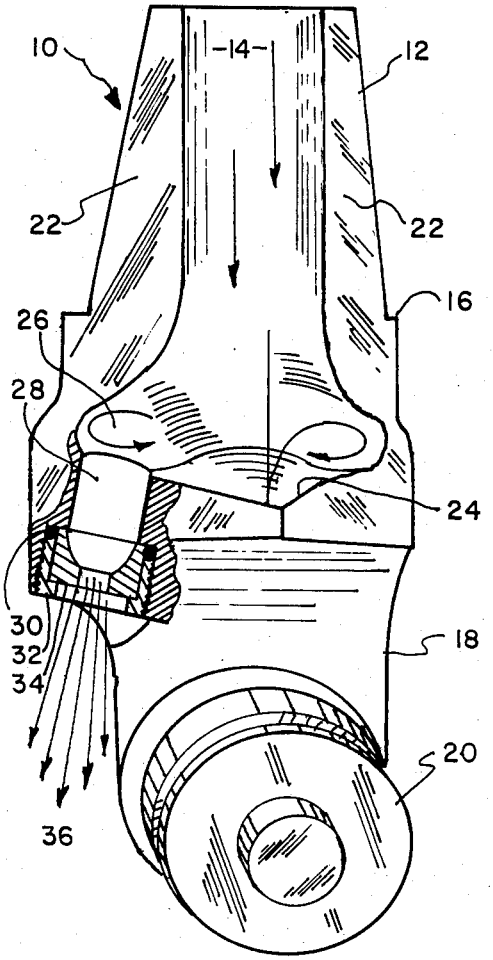
FIG 1 PRIOR ART
FIG. 1 illustrates a typical body segment from the prior art, shown partially in section to clarify the hydraulic nozzle detail.

With reference now to FIG. 1, a prior art body segment generally indicated at 10 is to have a rotary rock cutter cone rotatively mounted upon the machined journal 20, which is cantilevered from the downward extension leg 18. Three such assemblies are positioned with their common radial surfaces 22 matching in faying contact to be welded together into a solid body unit. The tapered upper end 12 is finally annealed and threaded, and the flange 16 is machined.

In service, drilling fluid enters the central bore 14 with high pressure and velocity, impinging the inside body floor 24. Coriolis circulations 26 form above outlet ports 28 to be accelerated through the ports 28 and carbide hydraulic nozzles 34 which are held in place in the bit by threaded retainer 32 against elastomeric seal 30. The cloverleaf shaped space above the body floor 24 is a generator of much hydraulic turbulence, which, in conjunction with the throttling action of the radially displaced nozzles, dissipates from about 50% to about 65% of the output energy of the mud pump, under the very best of operating conditions.

Figure 2:
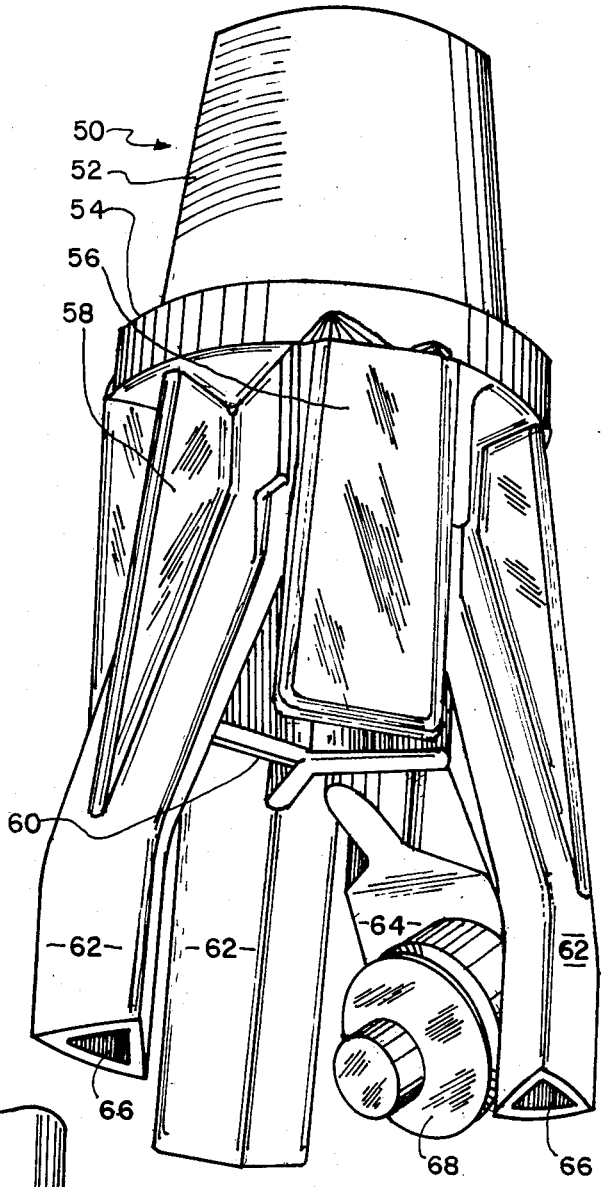
FIG. 2 depicts, in perspective, the preferred embodiment of the instant non-segmented bit body showing one journal member in place, the rotary rock cutter being omitted for clarity.
Figure 3:
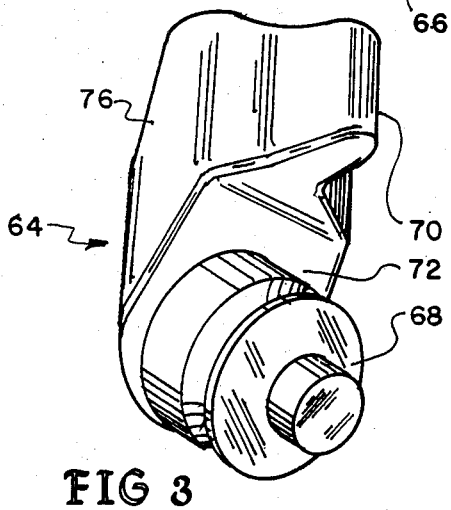
FIG. 3 is a perspective view of one individual journal member.

In contrast, the preferred embodiment of the instant invention is pictured in FIG. 2. The structure pictured is trilaterally symmetrical, designed to support three rock cutters. The unsegmented bit body generally indicated at 50 has a tapered nipple 52 which is threaded down to the machined flange 54. A stout flat spring 56 is cantilevered downward from flange 54, one such spring being provided to support each rotary rock cutter utilized. The spring 56, hereinafter called a "draw bar", is tapered in thickness, being thickest at the flange supported end, in order that operating stresses do not concentrate at the line of attachment to the flange.

The central bore (not shown) of upper threaded end 52, being circular in cross-section, is smoothly divided within threaded pin end 52 into radially diverging bores having sector shaped cross sections. These bores continue diverging downward through the flange and through tubular extensions 62 depending from the lower face of the flange and turning smoothly to paths paralleling the centerline of the bit, finally terminating in open ends 66 a short and uniform distance short of the extent to which the rotating rock cutters will be supported. These sector shaped tubular extensions, known as "mud snouts", taper downward in size within the divergent portion of their length, passing easily through the roughly triangular space existing between rotary cutters near the periphery of the bit, and then hold a constant section to the point of termination. The mud snouts 62, in addition to their natural strength provided by their triangular and tapered form, are externally ridgidized and supported by outboard radial gussets 58 and inboard radial web-cluster 60, which are formed integrally with the flange and the walls of the mud snouts.

Figure 4:
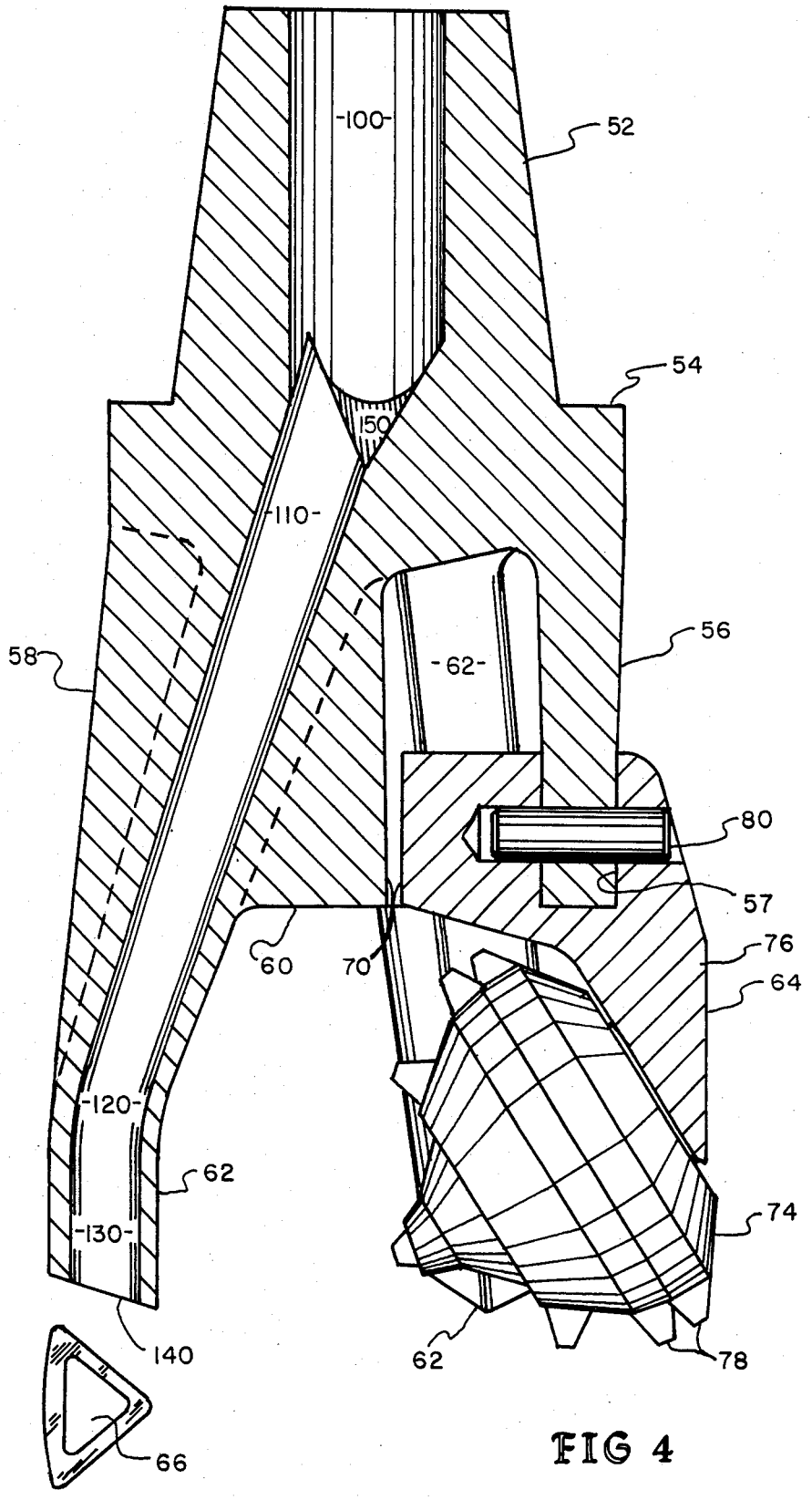
FIG. 4 is a partial cross section through a bit body structure of the preferred embodiment, showing the internal detail more clearly.

Referring now to FIG. 4, the unsegmented bit body supports individual journal members 64 from the lower ends of the draw bars 56. After the associated rotary rock cutter 74, bearing hard teeth 78, is assembled to the machined journal member 64, the free end of the draw bar 56 is placed into socket 57 formed within journal member body 76 with an interference fit. A secondary device, such as a cross pin 80 or key engaging both the assembled journal member and draw bar, as also preferred as a safety feature.

The sectioned view of FIG. 4 also serves to clarify the geometry of the internal hydraulic bores and the construction of the mud snouts. Drilling fluid enters the cylindrical central bore 100 of the threaded nipple of the bit body. The circular cross-section is divided into sectors, which define radially diverging bores 110, which continue downward through the flange 54 and through the tubular extensions 62 called "mud snouts". The bores 110 gently taper in section, within the divergent portion of their length, attaining both a size and form to pass through the generally triangular space between rotary rock cutters near the periphery of the bit. The mud snouts then turn at 120 to parallel the bit centerline with a constant cross section between the rock cutters, and travel straight at 130 and terminate at 140 in open ports 66 which discharge a very short distance above the functional rock drilling plane. This short distance is preferred to be from about 0.030 inch to about 0.300 inch. Even more preferred is a distance from about 0.060 to about 0.500.

The mud snouts are ridgidized and strengthened by both the integrally formed outboard gussets 58, and the integrally formed inboard web-cluster 60. In operation, forces tending to pinch the rotary rock cutters together are absorbed by the spring action of the draw bars 56. An inwardly directed projection 70 formed by the body 76 of the journal member 64, in cooperation with the centerline confluence of the web-cluster 60, forms an operational hard stop to limit radially inbound excursions of the journal member-rock cutter combination to a safe amount. The hard stop 70 is positioned to contact web-cluster 60 holding the rotary rock cutters out of mutually damaging interference with one another. When the pinching forces are reduced in magnitude then the spring action of the draw bars serve to return the rotary rock cutters to the normal operating position for continued drilling.

The steel alloy of construction is an ultra high strength, through-hardening variety, chosen for characteristics desirable for producing springs, for example, the chrome vanadium steel 6150. Such an alloy can be made to exhibit the combination of strength, hardness, and toughness required in the rock bit structures herein described by exercising very close and careful control over the conditions of heat treatment. A micro-structure as purely martensitic as possible, being nearly free of retained austenite, is very important if the rock bit structure is to withstand the extreme shock loading indigenous to deep rock drilling. Retained austenitic phase represents stress points which result from crystal dislocations. Any manufacturing process prone to produce micro-cracks or stress points within the micro-structure is to be avoided, because these are the seeds of failure via brittle fracture. The presently preferred system is to anneal to a predominantly perlitic condition prior to machining, and finally to carefully martemper. Thermal processes such as welding, brazing, or hardfacing will seriously upset the desired micro-structure and are certainly to be avoided.

The hydraulic objectives previously described are ideally achieved via the physical geometry of the unsegmented rock bit body herein described and depicted; the presently preferred embodiment. Although this configuration does not lend itself readily to the forging process, through good foundry practice consistently high quality parts are being formed by casting. The casting process also excells significantly over forging by maintaining consistency of part geometries in long term production.

It will of course be realized that various modifications can be made in the design and operation of the present invention without departing from the spirit thereof. Thus, while the principal construction and mode of operation of the invention have been explained in what is now considered to represent its best embodiments, which have been illustrated and described, it should be understood that within the scope of the appended claims, the invention may be practiced other than as specifically illustrated and described.

I claim:

1. An unsegmented rotary rock bit structure and hydraulic fitting comprising:

a circular flange having a first flat side and a second side opposite to said first side, a male threaded nipple extending normally and centrally from said first side of said circular flange, a plurality of spaced apart leaf-spring members cantilevered normally from said second side of said circular flange, a plurality of tubular members of sector-shaped cross section depending from a central portion of said second side of said circular flange, extending angularly from said flange and radially outward from said central portion of said second side of said flange, turning to mutually parallel paths passing between adjacent said leaf-spring members, each said tubular member having an abrupt terminal end at a predetermined uniform length, said rock bit structure forming therewithin a hydraulic conduit adapted for laminar fluid flow, said condiut being in mutual communication with a circular port in an extended end of said nipple and with a sector shaped port in said terminal end of each of said tubular members, and a plurality of individual journal shaft members, each further comprising;

a socket portion adapted to receive an unsupported end of one of said leaf-spring members in interference fit, and a load bearing journal shaft cantilevered from said socket portion being adapted to orient and rotatively support a rotary rock cutter in a position to extend a predetermined short distance beyond said terminal ends of said tubular members.

2. The invention as described in claim 1 wherein each of said tubular members is strengthened and supported by a radially oriented longitudinal gusset joining with an outboard wall of said tubular member and with said second side of said circular flange.

3. The invention as described in claim 1 wherein said load bearing journal shaft cantilevered from said socket portion is adapted to orient and rotatively support a rotary rock cutter in a position to extending a distance of from about 0.030 inch to about 0.500 inch beyond said terminal ends of said tubular members.

4. The invention as described in claim 1 wherein said load bearing journal shaft cantilevered from said socket portion is adapted to orient and rotatively support a rotary rock cutter in a position to extending a distance of from about 0.060 inch to about 0.300 inch beyond said terminal ends of said tubular members.

5. The invention as described in claim 1 wherein said tubular members are mutually strengthened and supported by a plurality of longitudinally oriented structural webs which mutually extend radially from a longitudinal centerline of said rock bit structure to join with an inboard wall of each of said tubular members and with said second side of said circular flange.

6. The invention as described in claim 5 wherein said socket portion of each said individual journal shaft member extends radially inward relative to said rock bit structure to form a hard stop having a spaced-apart relationship with said structural webs.

7. An unsegmented trilaterally symmetrical rock bit structure and hydraulic fitting comprising:

an integrally formed elongate main structural body further comprising:

a circular flange having a first flat side and a second side opposite said first side, a male threaded nipple extending normally and centrally from said first side of said circular flange, a trio of spaced apart leaf-spring members cantilevered normally from said second side of said circular flange, a trio of tubular members of sector-shaped cross section depending from a central portion of said second side of said circular flange, extending angularly from said flange and radially outward from said central portion of said second side of said flange, turning to mutually parallel paths passing between adjacent said leaf-spring members, each said tubular member having an abrupt terminal end at a predetermined length, a trio of longitudinal structural webs mutually extending radially from a longitudinal bit centerline to integrally join an inboard wall of each of said tubular members and to integrally join said second side of said circular flange, a trio of longitudinal gussets extending radially, each being formed integrally with an outboard of one of said tubular members, and being integrally formed with said second side of said circular flange, said elongate main structural body forming therewithin a smooth continuous hydraulic conduit adapted for laminar fluid flow, said conduit being in mutual communication between a circular port in an extended end of said nipple and with a sector shaped port in said terminal end of each of said trio of tubular members, and a trio of individual journal shaft members each further comprising;

a socket portion adapted to receive an unsupported end of one of said leaf-spring members in an interference fit, a hard stop extending radially inward relative to said elongate main structural body, having a spaced apart relationship with said structural webs, and a load bearing journal shaft cantilevered from said socket portion, said journal shaft adapted to orient and rotatively support a rotary rock cutter in a position to extend a distance of from about 0.030 inch to about 0.500 inch beyond said terminal ends of said tubular members.

8. The invention as described in claim 7 wherein said unsegmented rotary rock bit structure and hydraulic fitting is cast of 6150 chrome vanadium alloy steel.

9. The invention as described in claim 7 wherein said unsegmented rotary rock bit structure and hydraulic fitting is finally martempered.

* * * * *